US007372475B2

(12) United States Patent
Vazac et al.

(10) Patent No.: US 7,372,475 B2
(45) Date of Patent: May 13, 2008

(54) SYSTEM AND METHOD FOR THERMAL TRANSFER PRINT HEAD PROFILING

(75) Inventors: George Vazac, Apopka, FL (US); Ronald A. Schwallie, Lake Mary, FL (US); Kenneth Colonel, Oviedo, FL (US)

(73) Assignee: Datamax Corporation, Orlando, FL (US)

( * ) Notice: Subject to any disclaimer, the term of this patent is extended or adjusted under 35 U.S.C. 154(b) by 239 days.

(21) Appl. No.: 11/075,510

(22) Filed: Mar. 9, 2005

(65) Prior Publication Data

US 2006/0203075 A1 Sep. 14, 2006

(51) Int. Cl.
*B41J 2/32* (2006.01)

(52) U.S. Cl. ..... 347/171

(58) Field of Classification Search ..... 347/171, 347/193, 211, 218, 222, 3, 5, 49, 50
See application file for complete search history.

(56) References Cited

U.S. PATENT DOCUMENTS

| | | | |
|---|---|---|---|
| 3,611,144 | A | 10/1971 | Harmon, Jr. et al. |
| 3,646,448 | A | 2/1972 | Harmon, Jr. et al. |
| 3,652,986 | A | 3/1972 | Monroe |
| 3,683,367 | A | 8/1972 | Monroe et al. |
| 4,895,466 | A | 1/1990 | Hartman et al. |
| 4,909,648 | A | 3/1990 | Hartman et al. |
| 5,087,137 | A | 2/1992 | Burnard et al. |
| 5,326,182 | A | 7/1994 | Hagstrom |
| 5,381,295 | A | 1/1995 | Rund et al. |
| 5,491,540 | A | 2/1996 | Hirst |
| 5,546,112 | A | 8/1996 | Hunter et al. |
| 5,812,156 | A | 9/1998 | Bullock et al. |
| 5,836,704 | A | 11/1998 | Lau et al. |
| 5,886,726 | A | 3/1999 | Pawelka et al. |
| 5,927,875 | A | 7/1999 | Lau et al. |
| 5,938,350 | A | 8/1999 | Colonel |
| D432,568 | S | 10/2000 | Cameron |
| 6,127,678 | A | 10/2000 | Christensen et al. |
| 6,129,463 | A | 10/2000 | Lau et al. |
| 6,130,699 | A | 10/2000 | Christensen et al. |
| 6,155,732 | A | 12/2000 | Plasschaert et al. |
| 6,188,423 | B1 | 2/2001 | Pou |
| 6,202,954 | B1 | 3/2001 | Tobin et al. |

(Continued)

FOREIGN PATENT DOCUMENTS

| | | |
|---|---|---|
| WO | WO 99/26788 | 6/1999 |

(Continued)

*Primary Examiner*—K. Feggins
(74) *Attorney, Agent, or Firm*—Carter, DeLuca, Farrell & Schmidt, LLP

(57) ABSTRACT

A thermal transfer print head is disclosed. The print head includes a housing configured and dimensioned to be installable within the printer, a plurality of resistive heating elements positioned on an external surface of the housing and in thermal contact with a printable media, the resistive heating elements receive electrical energy from the printer and have adjustable thermal output, and a print head memory positioned within the housing and accessible by the thermal printer, the print head memory including a first and second memory regions, the first memory region configured to store a printing profile pertaining to operating parameters of the resistive heating elements and the second memory configured to store usage data pertaining to operation of the print head.

23 Claims, 4 Drawing Sheets

U.S. PATENT DOCUMENTS

| | | | | |
|---|---|---|---|---|
| 6,227,643 | B1 | 5/2001 | Purcell et al. | |
| 6,260,834 | B1 | 7/2001 | Colonel et al. | |
| 6,367,913 | B1 | 4/2002 | Anderson | |
| 6,396,070 | B1 | 5/2002 | Christensen et al. | |
| 6,575,548 | B1 | 6/2003 | Corrigan, III et al. | |
| 6,593,952 | B1 * | 7/2003 | Funayama et al. | 347/193 |
| 6,616,362 | B2 | 9/2003 | Bouverie et al. | |
| 6,722,753 | B2 | 4/2004 | Helterline et al. | |
| 2002/0097317 | A1 * | 7/2002 | Wood et al. | 347/218 |
| 2005/0219610 | A1 * | 10/2005 | Kimura et al. | 358/1.15 |

FOREIGN PATENT DOCUMENTS

| | | |
|---|---|---|
| WO | WO 99/26789 | 6/1999 |
| WO | WO 00/58104 | 10/2000 |
| WO | WO 00/63021 | 10/2000 |

* cited by examiner

SYSTEM AND METHOD FOR THERMAL TRANSFER PRINT HEAD PROFILING

BACKGROUND

1. Field of the Disclosure

The present disclosure relates to thermal transfer printing, more specifically, to a system and method for print head profiling in a thermal transfer printer and storing usage data pertaining to the print head therein.

2. Description of the Related Art

Currently, there are a variety of printing techniques to transfer ink or toner to a sheet of paper, such as liquid and solid ink printing, toner laser printing, dye-sublimation printing and thermal transfer printing. In the case of thermal printing, a thermal print head provides thermal energy to specific locations of thermal-reactive printing media such as a thermal transfer ribbon. Generally, a thermal print head has a plurality of independently controllable resistive heating elements, when activated, heat a transfer ribbon and transfer thermally reactive inks or dyes from the ribbon to the paper. During this process, the heating elements cause the ink in discrete regions of the ribbon to sublimate into a gaseous state for a brief period. The amount of ink transferred to the paper, and hence, the ink saturation or tone depends on the temperature of the heating elements.

Print heads are designed for use in specific printer models and are generally not interchangeable with print heads from other printers. This lack of interchangeability is due to printer design and operating parameters, which allow for print heads to be specifically tailored to a particular printer. Thus, all individual print heads of a particular model are designed to reliably and repeatedly produce equivalent print output when installed in the corresponding printer. However, imperfections during manufacture actually produce print heads that do not have identical characteristics and as a result have varying thermal responses. More specifically, the resistive heating elements produce varying amount of heat due to varying resistance. Thus, the individual print heads produce print output quality that is not exactly the same and only falls within an acceptable certain range.

To minimize the discrepancies exhibited by print heads, it is possible to tailor the thermal response of each print head to the printer to produce consistent high quality prints. This requires characterizing a print head and providing an individual profile tailored for the print head. This is beyond the expertise level of most end users. In addition, it requires a significant amount of time to create such a profile. Therefore, there is a need for a system which would provide a built-in profile of the characteristics of the individual print head allowing for a printer to compensate for the variations and provide a more uniform output.

SUMMARY OF THE INVENTION

System and method for thermal transfer print head profiling are disclosed. The system includes a print head configured for use in a thermal transfer printer, the print head having resistive heating elements for sublimating ink deposited on thermal transfer ribbon. In addition, the print head includes memory for storing a printing profile and usage data pertaining to the print head. The printing profile includes resistance values for the heating elements as well as other information concerning printing which is used by the printer to adjust the current passing through the print head to control printing quality. The print head also saves the usage data within the memory for later retrieval and analysis of the problems causing inoperability of the print head.

In one embodiment of the present disclosure a thermal transfer print head for use in a thermal transfer printer is disclosed. The print head includes a housing configured and dimensioned to be installable within the printer, a plurality of resistive heating elements positioned on an external surface of the housing and in thermal contact with a printable media, the resistive heating elements receive electrical energy from the printer and have adjustable thermal output, and a print head memory positioned within the housing and accessible by the thermal printer, the print head profile memory including a first and second memory regions, the first memory region configured to store a printing profile pertaining to operating parameters of the resistive heating elements and the second memory configured to store usage data pertaining to operation of the print head.

In another embodiment of the present disclosure a thermal transfer printing system having printing profile and usage data is disclosed. The printing system includes a thermal transfer printer having a control assembly and a print head installable in the thermal printer. The print head includes a housing configured and dimensioned to be installable within the printer, a plurality of resistive heating elements positioned on an external surface of the housing and in thermal contact with a printable media, the resistive heating elements receive electrical energy from the printer and have adjustable thermal output, and a print head memory positioned within the housing and accessible by the thermal printer, the print head profile memory including a first and second memory regions, the first memory region configured to store a printing profile pertaining to operating parameters of the resistive heating elements and the second memory configured to store usage data pertaining to operation of the print head.

In a further embodiment of the present disclosure, a method for improving output quality of a thermal transfer printer and tracking print head usage is disclosed. The method includes the steps of providing a print head having a memory including a first and second memory regions and a plurality of resistive heating elements positioned on an external surface thereof and in thermal contact with a print media, the resistive heating elements having adjustable thermal output, characterizing operating parameters of the resistive heating elements, collecting a printing profile pertaining to the operating parameters of the resistive heating elements and storing the printing profile in the first memory region, collecting usage data pertaining to operation of the print head and storing the usage data in the second memory region, and adjusting the thermal output of the resistive heating elements based on the printing profile.

According to another embodiment of the present disclosure, a thermal transfer print head for use in a thermal transfer printer is disclosed. The print head includes a housing configured and dimensioned to be installable within the printer, a plurality of resistive heating elements positioned on an external surface of the housing and in thermal contact with a printable media, the resistive heating elements receive electrical energy from the printer and have adjustable thermal output, and a print head memory positioned within the housing and accessible by the thermal printer, the print head memory including a first memory region, the first memory region configured to store a printing profile pertaining to operating parameters of the resistive heating elements and identification data identifying the print head as authorized for use in the printer.

According to a final embodiment of the present disclosure, a thermal transfer printing system having printing profile and identification data is disclosed. The printing system includes a thermal transfer printer having a control assembly and a print head installable in the thermal printer. The print head includes a housing configured and dimensioned to be installable within the printer, a plurality of resistive heating elements positioned on an external surface of the housing and in thermal contact with a printable media, the resistive heating elements receive electrical energy from the printer and have adjustable thermal output, and a print head memory positioned within the housing and accessible by the thermal printer, the print head memory including a first memory region, the first memory region configured to store a printing profile pertaining to operating parameters of the resistive heating elements and identification data identifying the print head as authorized for use in the printer.

BRIEF DESCRIPTION OF THE DRAWINGS

The above and other aspects, features, and advantages of the present disclosure will become more apparent in light of the following detailed description when taken in conjunction with the accompanying drawings in which.

DESCRIPTION OF THE PREFERRED EMBODIMENTS

Preferred embodiments of the present disclosure will be described herein below with reference to the accompanying drawings. In the following description, well-known functions or constructions are not described in detail to avoid obscuring the present disclosure in unnecessary detail.

The present disclosure provides for a system and method of profiling a thermal print head. The print head is configured to electrically connect to a thermal transfer printer and heat dyes deposited on a thermal transfer ribbon to transfer them to print media using resistive heating elements. The print head includes memory configured to store a printing profile and usage data. The printing profile includes information pertaining to the resistance of the heating elements which are used by the printer to adjust its current to achieve better printing quality. In addition, the usage data is extracted and analyzed to determine the cause of any problems and general usage statistics.

It should be appreciated by those skilled in the art that the various embodiments according to the present disclosure may be adapted for use in a plurality of printing systems and that the illustrated embodiment involving a thermal printing system is used for illustrative purposes.

Figure 1:
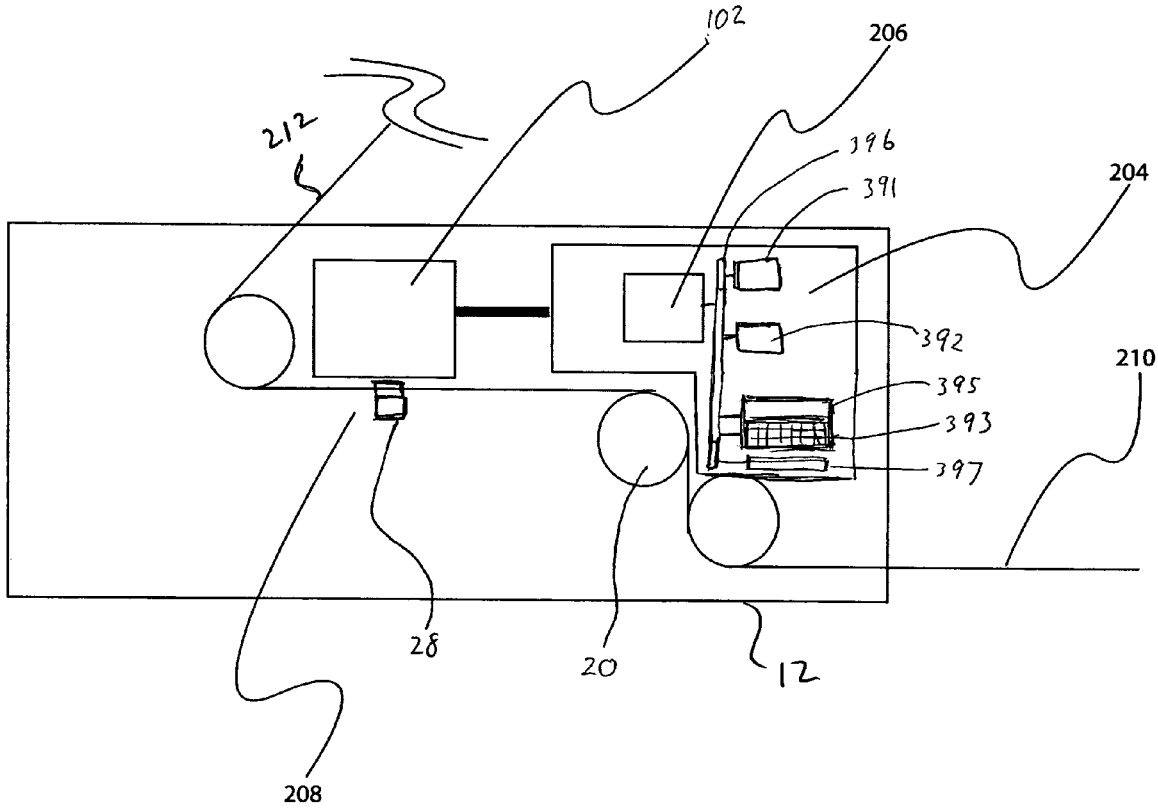
FIG. 1 is a block diagram of a thermal printer in accordance with the present disclosure.

Referring to FIG. 1, a thermal printer 12 is shown including a controller assembly 204 having a processor 206, a random access memory (RAM) 391, a read only memory (ROM) 392 and input/output (I/O) interface(s) such as a keypad 393, a and display device 395. Furthermore, the printer 12 may also include a networking device 397 which provides wired or wireless connectivity to a network. In addition, various other peripheral devices may be connected to the thermal printer 12 by various interfaces and bus structures, such as a parallel port, serial port or universal serial bus (USB). A system bus 396 may be included which couples the various components and may be any of several types of bus structures including a memory bus or memory controller, a peripheral bus, and a local bus using any of a variety of different bus architectures.

The printer 12 may also be configured to include an operating software and micro instruction code. The various processes and functions described herein may either be part of the micro instruction code, firmware, or part of the application program (or a combination thereof) which is executed via the operating system. In addition, the thermal printer 12 may be designed to include software for displaying user input screens and recording user responses as discussed in more detail below.

It is to be further understood that because some of the constituent system components and method steps depicted in the accompanying figures may be implemented in software, the actual connections between the system components (or the process steps) may differ depending upon the manner in which the present disclosure is programmed. Given the teachings of the present disclosure provided herein, one of ordinary skill in the related art will be able to contemplate these and similar implementations or configurations of the present disclosure.

The processor 206 is primarily used to perform operational tasks required for printing and controlling a print head 102, a ribbon system 28, and a media system 20, consisting of guide ramps, feed rollers, sensors, motors, etc. The media system 20 transports printer media (e.g., sheets of paper, labels, cards, etc.) from an input port 210 through a printing area 208 where the ribbon system 28 passes a thermal transfer ribbon (not shown) between the print head 102 and the media. The dyes deposited on the ribbon are heated by the print head 102 and are sublimated on the media to generate a print output, according to the output commands and data received from the control assembly 204. The printed media is thereafter transported by the media system 20 through an output port 210.

Figure 2:
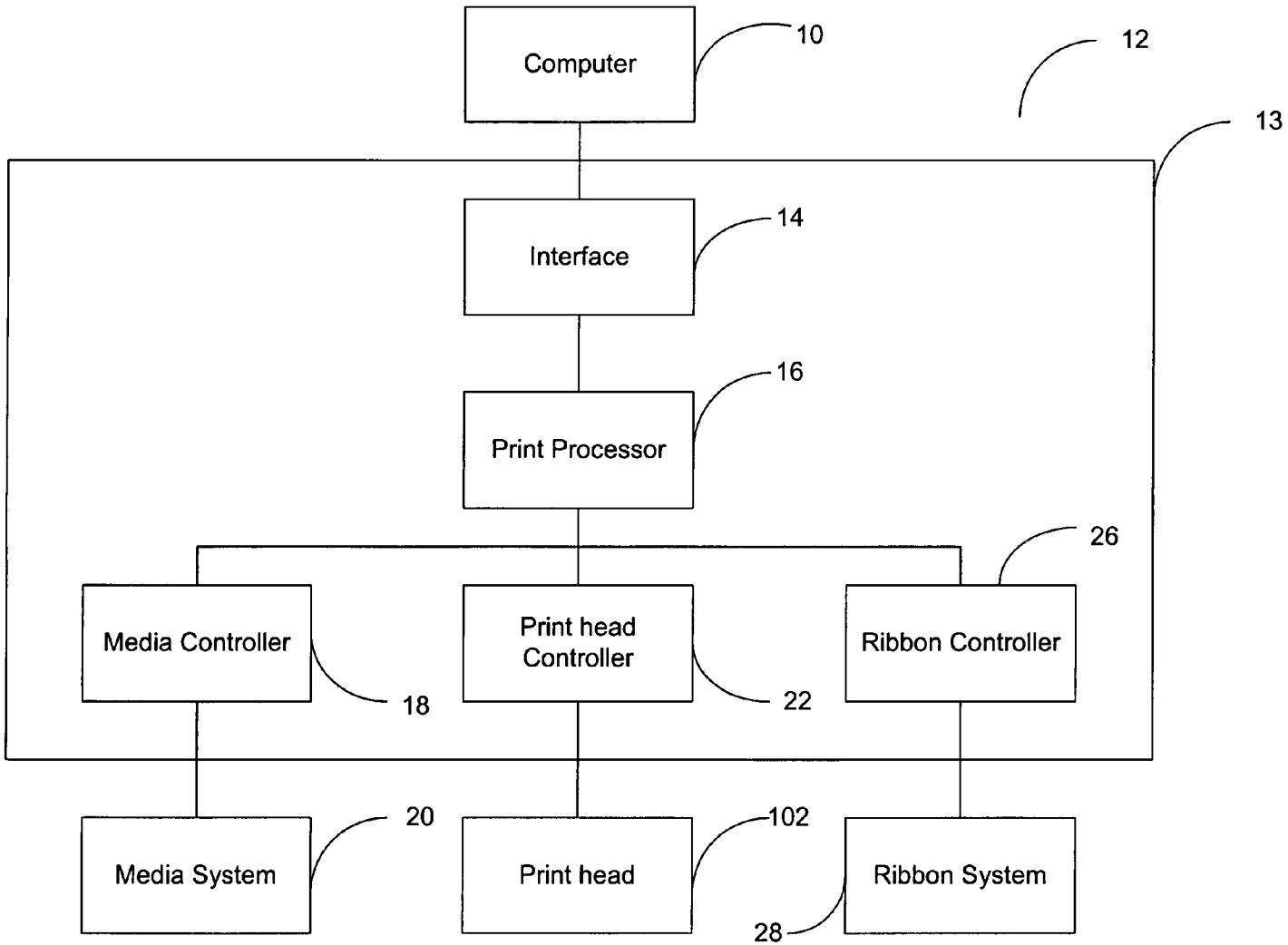
FIG. 2 is a block diagram of software components of the thermal printer of FIG. 1 in accordance with the present disclosure.

FIG. 2 shows a print engine 13 for printing content. The printer engine 13 may be a software module stored within the controller assembly 204. The printer engine 13 receives data for output (e.g., images and/or text, etc.) from a computer 10 through an interface 14 configured to accept and process incoming data and/or commands. The printer engine 13 also includes a print processor 16 for controlling the operation of the printer engine 13. The print processor 16 interfaces with a media controller 18, print head controller 22, and ribbon controller 26. The media controller 18 controls the media system 20 and its components which may include guide ramps, feed rollers, sensors, motors, etc. Furthermore, the media controller 18 monitors the progress of the media through the printer 12. The ribbon controller 16 controls the ribbon system 28 which passes the thermal transfer ribbon between the print media and the print head 102. The print processor 16 controls the print head 102 through the print head controller 18 by adjusting the heat generated the print head 102. In addition, the print head controller 18 communicates with the print head 102 to create and/or read printing profile and generate and store usage data. These functions will be discussed in more detail in conjunction with FIG. 4.

Figure 3:
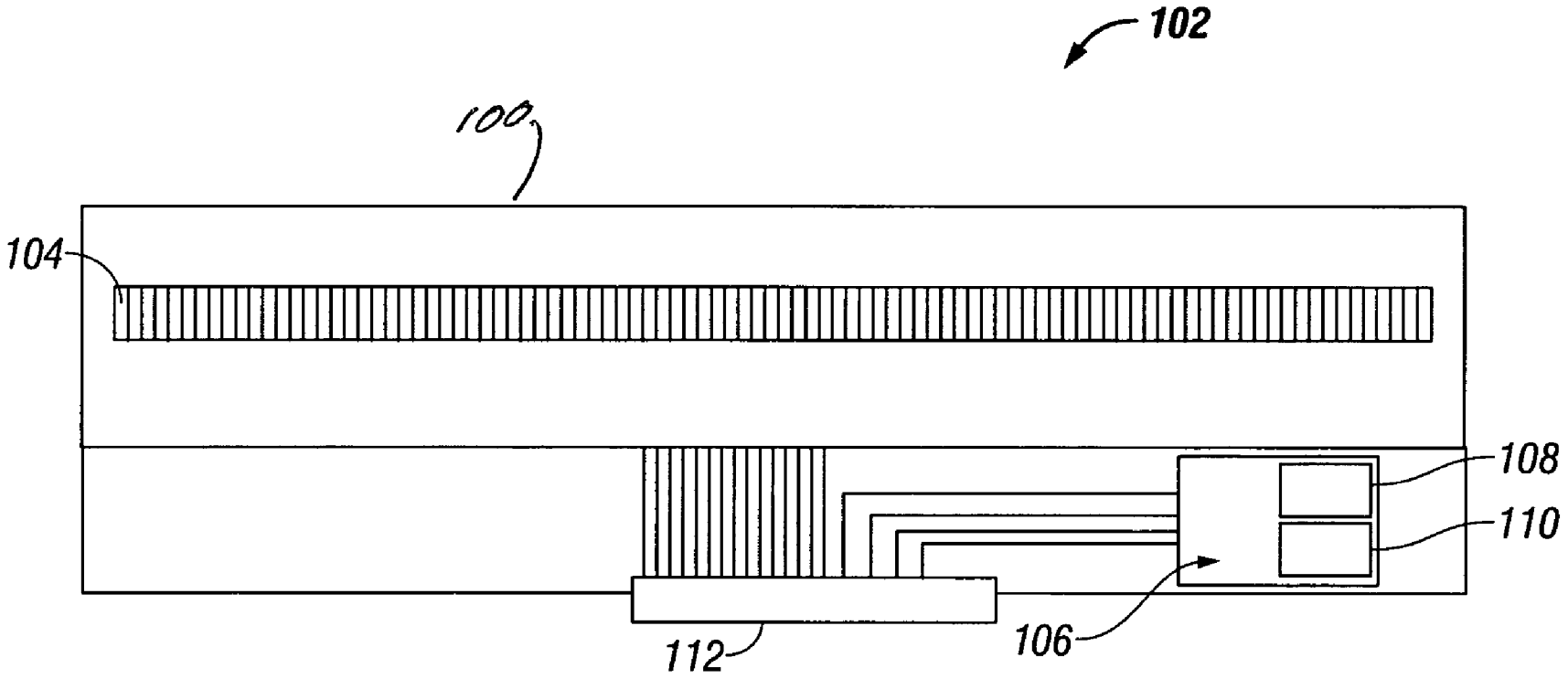
FIG. 3 is a schematic of a thermal print head in accordance with the present disclosure.

FIG. 3 shows a schematic of the print head 102 which includes a housing 100, a plurality of resistive heating elements 104, a print head memory 106 having a first memory region 108 and a second memory region 110, and a connector 112 for electrical communication with the controller assembly 204. The housing 100 is configured and dimensioned to be installable within the printer 12. The plurality of resistive heating elements 104 is positioned on an external surface of the housing 100 and in thermal contact with the printable media. The print head memory 106 is positioned within the housing.

The heating elements 103 are activated by passing electrical energy therethrough based on the commands from the control assembly 204. During activation, the heating elements 103 heat the ribbon which causes the ink deposited therein to transfer to the printing media. The activation of the heating elements 103 and other operations of the print head 102 is controlled by the print head controller 22.

Preferably, the print head memory 106 is non-volatile and may be provided by a printed circuit board mounted along the print head 102. Furthermore, those skilled in the art will understand that the print head memory 106 may include a plurality of memory regions and that the described-above first and second memory regions 106 and 108 are used to illustrate the two types of data stored therein (e.g., printing profile and usage data) as discussed in more detail below.

The print head memory 106 stores a printing profile for the print head 102 in the first memory region 108. The printing profile may include operating characteristics such as the print head manufacturer, the date of manufacture, the maximum and average resistance of the heating elements 103, thermal constants at which the print head 102 dissipates heat and other operational parameters. The operational parameters may be customized with respect to a specific model of the print head 102 to allow for the electrical adjustment necessary for proper operation of the print head 102 with the printer 12. This data facilitates in improving print quality since the printer 12 obtains the data from the print head 102 and adjusts its controls accordingly.

More particularly, the printing profile includes resistance values of the heating elements 103 to allow the printer 12 to adjust the voltage passing through the printer head 102 to obtain consistent results of the ink deposited on the media. Furthermore, since the first memory region 108 is primarily used for providing data to the printer, preferably it is marked as read only memory. This provides greater safeguards against accidental or deliberate tampering with the printing profile.

In addition, the print head memory 106 stores usage data pertaining to the operation of the print head 102 in the memory region 110. The usage data may include average current passing through the heating elements 103, printing load, printing commands, etc. This data may be valuable to the manufacturer of the print head 102 in analyzing the performance of the print head 102. More specifically, it is useful in determining design and manufacture defects in faulty units which may be returned to the manufacturer after failing. Thereafter, the manufacture would extract the usage data to facilitate its fault recovery process. In addition, since the second memory region 110 is used for writing and extracting data (e.g., writing from the printer 12 to the print head 102 to obtain usage data and extracting from the print head 102 for analysis of usage data) preferably it is marked as read and write memory.

It is also envisioned that print head memory 106 may be also configured to store identification data to identify itself as an approved print head (e.g., manufactured specifically to work with the printer 12 and having the printing profile for optimal performance with the printer 12). The printing profile for the print head 102 is only extracted once the identification data is processed by the printer 12. Thereafter, the control assembly 204 accesses the print head memory 106 to retrieve the printing profile.

This embodiment prevents unauthorized print heads from attempting to load unapproved and/or untested printing profiles. For instance, a third party manufacturer may attempt to duplicate a printing profile for an unauthorized print head to attempt to match the performance of a native print head 102. Such third party profiling is undesirable since it may damage the printer 12. Therefore, the identification data prevents the use of third party and/or unauthorized print heads from passing unauthorized printing profiles to the printer 12. It is also envisioned that identification data may be used to prevent third party print heads from communicating with the control assembly 204, thereby preventing their use in the printer 12.

Figure 4:
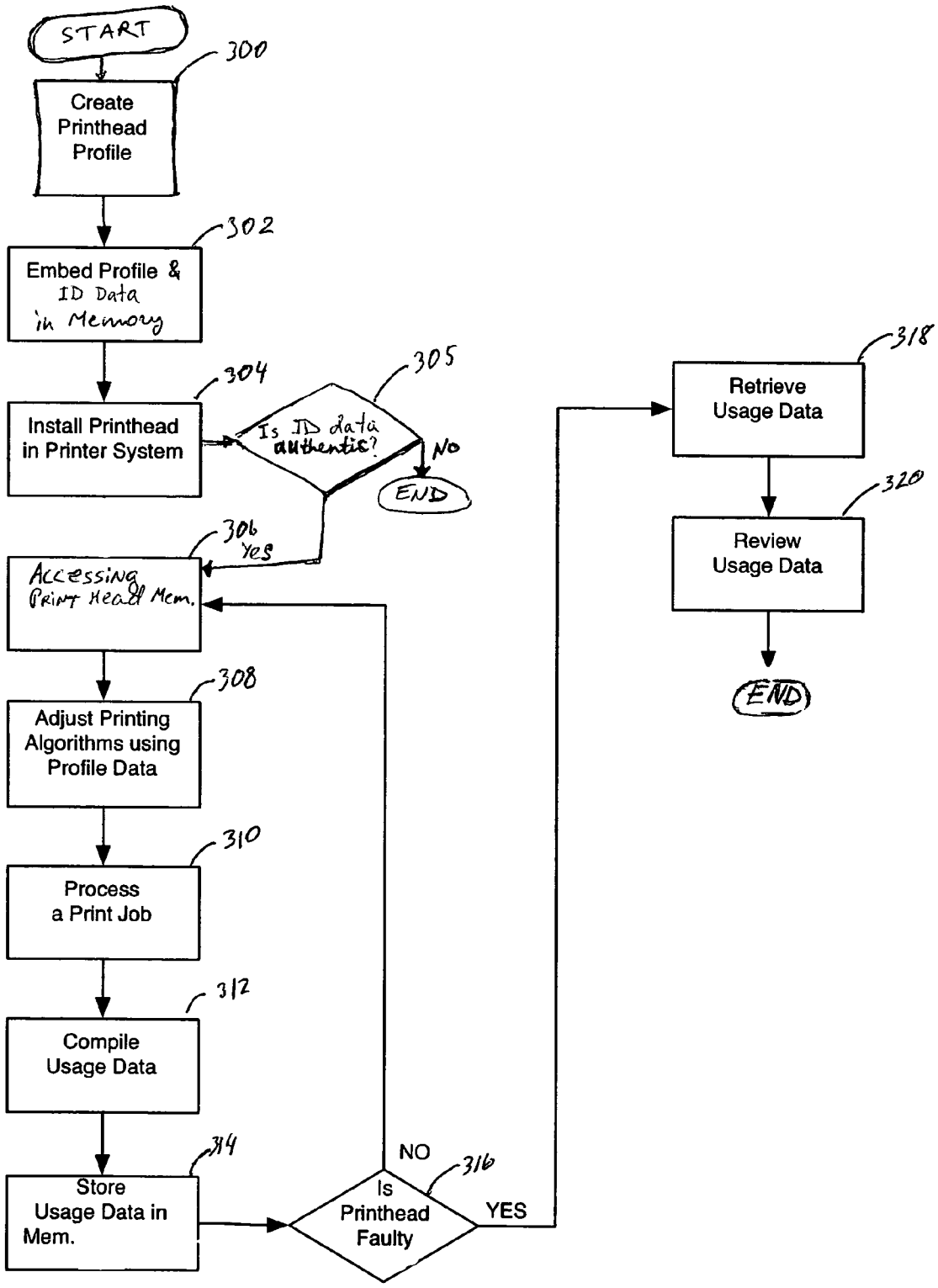
FIG. 4 is a flowchart of a method for improving output quality of a thermal printer in accordance with the present disclosure.

FIG. 4 shows a method for improving output quality of the printer 12 using the print head memory 106. In step 300, a profile for the print head 102 is created including the parameters discussed above. The profile may be created during manufacture and is stored in the first memory region 108 in step 302. In addition, the profile may be created by the printer 12 during initial use of the print head 102. The printer 12 may include software within the control assembly 204 to measure the resistance of the heating elements 103 and then store those values as the printing profile in the first memory region 108. In addition, the identification data is also embedded in the first memory region 108.

The profile and the identification data are encrypted in order to prevent unauthorized third parties from accessing the data pertaining to printing parameters of the print head 102. Usually, such data is proprietary, hence, it is desirable to protect the data in order to discourage manufacture of third party print heads, the usage of which may result in poor quality printing. Encryption may be accomplished by using any of widely available encryption algorithms and methods or using specialized chips, such as CryptoMemory.

In step 304, the print head 102 is installed into the printer 12 and the connector 112 electrically connects the print head 102 to the control assembly 204. The print head memory 106 is also accessed by the processor 206 which verifies that the print head 102 is authentic by retrieving the identification data in step 305. If the print head 102 is not authentic, the printer 102 does not retrieve the printing profile and operates in a standard manner. Optionally, the printer 102 may not even operate with the unauthentic print head.

If the identification data confirms that the print head 102 is authentic, the process proceeds to step 306, where the control assembly 204 accesses the print head memory 106 to retrieve the printing profile from the first memory region 108 and to create a usage data file and store it in the second memory region 110. Following the profile retrieval, in step 308, the controller assembly 204 adjusts printing algorithms based on the printing profile, thus compensating for variations in resistive heating element response and improving printing quality.

Once the printing profile is loaded by the control assembly 204, the printer 12 is ready for printing. In step 310, the printer 12 processes a print job, which involves receiving printing commands and data from the computer 10 through the interface 14 and processing them using the print processor 16. The print processor 16 activates the corresponding components of the printer 12 as well as print head 102 based on the retrieved printing profile.

Upon completion of each print job, in step 312, the printer 12 compiles relevant usage information, such as date the print head was purchase and/or installed, number of pages printed, total coverage, coverage per page, number of times each resistive heating element has been activated and duration, thermal output of each resistive heating element, printer model and serial number, etc. The usage data is stored in the second memory region 120 in step 314.

In step 316, it is determined if the print head 102 is operating properly. This may be done automatically and/or manually. The end user of the printer 12 may notice degradation in the print quality and thus discover that the print head 102 is faulty. In addition, the printer 12 may analyze the usage data to determine whether the print head 102 is performing below acceptable standards. If the print head 112 is performing properly, the process loops to step 306 where the printer 12 continues to process print jobs. If the print head 112 is faulty, the end user then removes the print head 102 and contacts the manufacturer for service and/or replacement. It is envisioned that the user may also return the print head 112 for regular scheduled maintenance (e.g., adjustment).

In step 318, the manufacturer, upon receiving the returned print head 102 retrieves the usage data from the second memory region 110. The manufacturer 320 thereafter analyzes the usage data in step 320 to determine the cause of the malfunction. Such data may be used to identify the cause of error (e.g., improper operation, design and/or manufacture defect, etc.). This data may be also used by the manufacturer to design better print heads and alleviate any of the problems inherent in the prior designs. If the problem was caused by the end user, then the manufacturer may also discover such misuse and terminate any warranty or service coverage the print head may have had.

The present disclosure provides a print head for a thermal transfer printer having a memory electrically connected to the printer during operation. The print head stores a printing profile having resistance information of heating elements and usage data pertaining to the printing activities performed by the print head. The printing profiles allows the printer to configure its current output to correspond to the resistance of the print head thereby to improve print quality, extend the operational life time of the print head, and improve the rate of printing. Moreover, the usage data stored within the print head provides invaluable data pertaining to the printing performance of the print head.

The described embodiments of the present disclosure are intended to be illustrative rather than restrictive, and are not intended to represent every embodiment of the present disclosure. Various modifications and variations can be made without departing from the spirit or scope of the disclosure as set forth in the following claims both literally and in equivalents recognized in law.

What is claimed is:

1. A thermal transfer print head for use in a thermal transfer printer, the print head comprising:

a housing configured and dimensioned to be installable within the printer;

a plurality of resistive heating elements disposed on an external surface of the housing and in thermal contact with a printable media, the resistive heating elements having adjustable thermal output and being configured to receive electrical energy from the printer; and a print head memory disposed within the housing and accessible by the thermal printer, the print head memory including a first and second memory regions, the first memory region configured to store a printing profile pertaining to operating parameters of the resistive heating elements and the second memory configured to store usage data pertaining to operation of the print head, wherein the printing profile and the usage data are stored in an encrypted format within the first and second memory regions respectively.

2. The print head as in claim 1, wherein the printer adjusts the thermal output of the resistive heating elements based on the printing profile.

3. The print head as in claim 1, wherein the usage data is generated by the thermal printer and analyzed to obtain information concerning operability of the print head.

4. The print head as in claim 1, wherein the usage data includes installation date of the print head, number of pages printed, total coverage of the print head, coverage per page, duration of the activation of the heating elements, the printer model and serial number of the print head.

5. The print head as in claim 1, wherein the first memory region is read only memory.

6. The print head as in claim 1, wherein the second memory region is read and write memory.

7. A thermal transfer printing system having printing profile and usage data, the printing system comprising:

a thermal transfer printer having a control assembly; and a print head installable in the thermal printer, the print head comprising:

a housing configured and dimensioned to be installable within the printer;

a plurality of resistive heating disposed on an external surface of the housing and in thermal contact with a printable media, the resistive heating elements having adjustable thermal output and being configured to receive electrical energy from the printer; and a print head memory disposed within the housing and accessible by the thermal printer, the print head memory including a first and second memory regions, the first memory region configured to store a printing profile pertaining to operating parameters of the resistive heating elements and the second memory configured to store usage data pertaining to operation of the print head, wherein the printing profile and the usage data are stored in an encrypted format within the first and second memory regions respectively.

8. The system as in claim 7, wherein the printer adjusts the thermal output of the resistive heating elements based on the printing profile.

9. The system as in claim 7, wherein the usage data is generated by the thermal printer and analyzed to obtain information concerning operability of the print head.

10. The system as in claim 7, wherein the usage data includes installation date of the print head, number of pages printed, total coverage of the print head, coverage per page, duration of the activation of the heating elements, the printer model and serial number of the print head.

11. The system as in claim 7, wherein the first memory region is read only memory.

12. The system as in claim 7, wherein the second memory region is read and write memory.

13. A method for improving output quality of a thermal transfer printer and tracking print head usage, the method comprising the steps of:

providing a print head having a memory including a first and second memory regions and a plurality of resistive heating elements disposed on an external surface thereof and in thermal contact with a print media, the resistive heating elements having adjustable thermal output;

characterizing operating parameters of the resistive heating elements;

collecting a printing profile pertaining to the operating parameters of the resistive heating elements;

collecting usage data pertaining to operation of the print head;

storing the printing profile and the usage data in an encrypted format within the first and second memory regions respectively; and adjusting the thermal output of the resistive heating elements based on the printing profile.

14. The method as in claim 13, wherein the first memory region is read only memory.

15. The method as in claim 13, wherein the second memory region is read and write memory.

16. The method as in claim 13, wherein the usage data includes installation date of the print head, number of pages printed, total coverage of the print head, coverage per page, duration of the activation of the heating elements, the printer model and serial number of the print head.

17. The method as in claim 13, wherein the usage data is generated by the thermal printer and analyzed to obtain information concerning operability of the print head.

18. A thermal transfer print head for use in a thermal transfer printer, the print head comprising:

a housing configured and dimensioned to be installable within the printer;

a plurality of resistive heating elements disposed on an external surface of the housing and in thermal contact with a printable media, the resistive heating elements having adjustable thermal output and being configured to receive electrical energy from the printer; and a print head memory disposed within the housing and accessible by the thermal printer, the print head memory including a first memory region, the first memory region configured to store a printing profile pertaining to operating parameters of the resistive heating elements and identification data identifying the print head as authorized for use in the printer, wherein the printing profile and the identification data are stored in an encrypted format within the first memory region.

19. The print head as in claim 18, wherein the printer adjusts the thermal output of the resistive heating elements based on the printing profile.

20. The print head as in claim 18, wherein the first memory region is read only memory.

21. A thermal transfer printing system having printing profile and identification data, the printing system comprising:

a thermal transfer printer having a control assembly; and a print head installable in the thermal printer, the print head comprising:

a housing configured and dimensioned to be installable within the printer;

a plurality of resistive heating elements disposed on an external surface of the housing and in thermal contact with a printable media, the resistive heating elements having adjustable thermal output and being configured to receive electrical energy from the printer; and a print head memory disposed within the housing and accessible by the thermal printer, the print head memory including a first memory region, the first memory region configured to store a printing profile pertaining to operating parameters of the resistive heating elements and identification data identifying the print head as authorized for use in the printer, wherein the printing profile and the identification data are stored in an encrypted format within the first memory region.

22. The system as in claim 21, wherein the printer adjusts the thermal output of the resistive heating elements based on the printing profile.

23. The system as in claim 21, wherein the first memory region is read only memory.

* * * * *